US008950070B2

(12) United States Patent
Kimura et al.

(10) Patent No.: US 8,950,070 B2
(45) Date of Patent: Feb. 10, 2015

(54) METHOD OF FORGING TURBINE BLADE

(75) Inventors: Koji Kimura, Aichi (JP); Takuma Okajima, Aichi (JP)

(73) Assignee: Daido Steel Co., Ltd., Aichi (JP)

( * ) Notice: Subject to any disclaimer, the term of this patent is extended or adjusted under 35 U.S.C. 154(b) by 0 days.

(21) Appl. No.: 13/544,151

(22) Filed: Jul. 9, 2012

(65) Prior Publication Data

US 2013/0014387 A1 Jan. 17, 2013

(30) Foreign Application Priority Data

Jul. 11, 2011 (JP) ..... 2011-152493

(51) Int. Cl.
*B21D 53/78* (2006.01)
*B21K 3/04* (2006.01)

(52) U.S. Cl.
CPC ..... *B21K 3/04* (2013.01)
USPC ..... 29/889.7; 72/352; 416/232 A

(58) Field of Classification Search
CPC ..... B23P 15/02; B32K 3/04; B21J 5/02; B21J 9/00; B21D 53/78; B21K 3/04
USPC ..... 29/889.7, 889.71; 72/352; 416/232 A
See application file for complete search history.

(56) References Cited

U.S. PATENT DOCUMENTS 1,307,082 A * 6/1919 Dahlstrand ..... 29/889.7
2,148,672 A * 2/1939 Arentzen ..... 29/410
2,254,629 A * 9/1941 Stine ..... 72/337
2,972,181 A * 2/1961 Hollis et al. ..... 29/889.7
3,002,264 A * 10/1961 Hollis et al. ..... 29/889.7
3,012,308 A * 12/1961 Zech et al. ..... 29/889.7
4,531,270 A * 7/1985 Griffith et al. ..... 29/889.7
7,089,664 B2 * 8/2006 Ohishi ..... 29/889.7
2009/0101239 A1 * 4/2009 Nakamura et al. ..... 148/206

FOREIGN PATENT DOCUMENTS

JP 63-112039 5/1988
JP 2-80149 3/1990
JP 3-23026 1/1991

OTHER PUBLICATIONS

U.S. Appl. No. 13/544,275 to Koji Kimura et al., which was filed on Jul. 9, 2012.

* cited by examiner

*Primary Examiner* — David Bryant
*Assistant Examiner* — Jun Yoo
(74) *Attorney, Agent, or Firm* — Greenblum & Bernstein, P.L.C.

(57) ABSTRACT

The present invention relates to a method of forging turbine blade, which comprises forging a plurality of turbine blades as an integrally connected body in a longitudinal direction, and then separating the integrally connected body into said respective turbine blades. According to the method of the invention, a yield of material can be improved as compared with the conventional art and the number of processes for forging work can be reduced. In addition, the turbine blades cab be forged into a favorable shape without occurring cracks. Further, it is possible to effectively reduce the cost for the die required for the forging work.

6 Claims, 4 Drawing Sheets

METHOD OF FORGING TURBINE BLADE

FIELD OF THE INVENTION

The present invention relates to a method of forging turbine blade.

BACKGROUND OF THE INVENTION

As a production method of turbine blade, conventionally, a method of producing the turbine blade by shaving it out of a block material has been generally conducted.

However, in case where the turbine blade is shaved out of the block material, a yield of material is very poor, and the yield is about 10% with respect to a finished product.

On the other hand, when producing a turbine blade, it has been also conducted to forge the turbine blade as a single body.

For example, forging a turbine blade as a single body is disclosed in the following Patent Documents 1 and 2.

In a case of forging a turbine blade, there is a problem that although the yield of material is enhanced, a cost for forging dies is incurred.

Moreover, in a case where turbine blades are individually forged as single bodies, the number of processes for forging is increased, and after forging, it takes a lot of troubles and time for machining for finishing the turbine blades into a final shape and size, including setups for the machining.

In the following Patent Document 3, there is disclosed a forging method of simultaneously forging two forging products with a single die.

However, Patent Document 3 is different from the present invention, because it relates to a forging method of a connecting-rod and does not relate to a method of forging two forging products as an integrally connected body.

Patent Document 1: Japanese Patent Publication No. JP-A-2-80149

Patent Document 2: Japanese Patent Publication No. JP-A-63-112039

Patent Document 3: Japanese Patent Publication No. JP-A-3-23026

SUMMARY OF THE INVENTION

The invention has been made in view of the above described circumstances, and it is an object of the invention to provide a method of forging turbine blade in which a yield of material can be improved as compared with the conventional art and the number of processes for forging work can be reduced.

Moreover, in addition to the improvement of the yield of material and reduction of the processes for the forging work, it is another object of the invention to forge the turbine blades into a favorable shape without occurring cracks.

Further, it is still another object of the invention to effectively reduce the cost for the die required for the forging work.

Namely, the present invention provides the following items 1 to 7.

1. A method of forging turbine blade, which comprises forging a plurality of turbine blades as an integrally connected body in a longitudinal direction, and then separating the integrally connected body into said respective turbine blades.

2. The method of forging turbine blade according to item 1 above, wherein a connecting part is provided between adjacent ends of said respective turbine blades as a superfluous part for connecting said ends of the turbine blades, and the turbine blades are forged in a state of being integrally connected in the longitudinal direction through the connecting part.

3. The method of forging turbine blade according to item 2 above, wherein the connecting part is provided as a shape transition part, in which a shape of the connecting part sequentially changes from its one end to the other end which have different shapes from each other, so that the shape is transitioned from the one end to the other end.

4. The method of forging turbine blade according to any one of items 1 to 3 above, wherein said forging is carried out in such a manner that thick-walled parts having a larger wall thickness than blade parts are positioned at both ends in the longitudinal direction of adjacent two turbine blades in a state of being integrally connected.

5. A method of forging turbine blade according to item 4 above, wherein both of said two turbine blades are a blade, and said forging is carried out in a state where the turbine blades are oppositely directed in the longitudinal direction, so that blade roots as the thick-walled parts are positioned at the both ends in the longitudinal direction.

6. The method of forging turbine blade according to any one of items 1 to 5 above, wherein at least two of said plurality of turbine blades are turbine blades of different types in which stage numbers are different from each other.

7. The method of forging turbine blade according to item 6 above, wherein the turbine blades of different types in which the stage numbers are different from each other are turbine blades on adjacent stages which are different from each other by one stage.

As described above, according to the invention, a plurality of turbine blades are forged as an integrally connected body in the longitudinal direction, and thereafter, the integrally connected body is separated into the individual turbine blades. According to the invention, the turbine blades can be obtained, as a plurality of forged products, from one forging material with high efficiency, and an amount of burrs which occur during the forging work can be reduced. As a result, it is possible to enhance a yield of material, as compared with a case where the turbine blade is forged as a single body.

Moreover, since a plurality of the turbine blades can be forged by one forging, processes in the forging work can be reduced, and productivity is enhanced.

Generally, for the forged turbine blade, a machining, such as cutting, for finishing the forged turbine blade into a final shape and size is applied to all over the turbine blade surface.

On this occasion, the forged products which have been obtained according to the conventional forging method are in a state of individual single bodies, and therefore the machining is independently conducted on the individual forged products.

On the other hand, according to the forging method of the invention, it is possible to simultaneously perform the machining on a plurality of the turbine blades, because a plurality of the turbine blades, as the forged products, are integrally forged in the connected state in the longitudinal direction.

In this case, the number of processes for the machining can be effectively decreased.

According to the invention, it is possible to provide a connecting part between adjacent ends of respective turbine blades as a superfluous part for connecting the ends of the turbine blades, and the turbine blades can be forged in a state of being integrally connected in the longitudinal direction through the connecting part (item 2).

In a case where the connecting part is provided between the two turbine blades as the superfluous part as described above, when the machining is applied to the turbine blades in the connected state after forging, it is possible to grasp the connecting part with a chuck of a machining device. As a result, the turbine blades which are elongated in the connected state can be firmly and rigidly held with preventing them from swaying during the work.

In conclusion, owing to the presence of the connecting part, it is possible to conduct the machining simultaneously on a plurality of the turbine blades in the mutually connected state.

In this case, the connecting part can be provided as a shape transition part, in which the shape of the connecting part sequentially changes from its one end to the other end which have different shapes from each other, so that the shape is transitioned from the one end to the other end (item 3).

According to the invention, it is also possible to forge a plurality of the turbine blades in a state where they are directly connected so as to be butted against each other.

However, in this case, a step height (uneven step) inevitably occurs in a region where the adjacent turbine blades are butted against each other.

Such a step height becomes a factor for causing cracks in the forged products during the forging work.

However, by providing the connecting part in accordance with item 2 above, this connecting part can be utilized as the shape transition part according to item 3 above. In this case, occurrence of the step height between the adjacent turbine blades can be prevented, and occurrence of the cracks due to the step height during the forging work can be favorably prevented. As a result, it is possible to obtain the forged products which are free from cracks and have a favorable shape.

According to the invention, the turbine blades can be forged in such a manner that the thick-walled parts having a larger wall thickness than the blades parts are positioned at the both ends in the longitudinal direction of the adjacent two turbine blades in a state of being integrally connected (item 4).

In this manner, when a plurality of the turbine blades are subjected to the machining in the integrally connected state after the forging work, it is possible to rigidly and firmly grasp and hold the plurality of the turbine blades in the connected state, by grasping the thick-walled parts which are positioned at the both ends in the longitudinal direction of the two turbine blades with the chucks of the machining device. As a result, it is possible to conduct the machining simultaneously on the plurality of the turbine blades in the connected state, similar to the case of providing the connecting part.

Particularly, in a case where a blade at a rotation side as a single body is subjected to a machining, although its blade root, which is a thick-walled part, can be grasped with a chuck at one end in the longitudinal direction, the thin blade part itself must be grasped with another chuck at the other end to conduct the machining. In this case, a part of the blade part which is grasped with the chuck must be removed by cutting after the machining.

However, according to item 5 above, in case where both the two adjacent turbine blades are a blade, and the turbine blades are forged in a state where they are oppositely directed in the longitudinal direction so that their blade roots as the thick-walled parts are positioned at the both ends in the longitudinal direction, it is possible to apply the machining to the two adjacent blades in a state where the two blade roots as the thick-walled parts which are positioned at the both ends in the longitudinal direction are grasped with the chucks. As a result, necessity of grasping the blade part having a smaller wall thickness with the chuck can be eliminated.

In the invention, although a plurality of the turbine blades may be all of the same type, at least two of a plurality of the turbine blades can be the turbine blades of different types having different stage numbers from each other, in accordance with item 6 above.

In a case where a plurality of the turbine blades are all of the same type having the same stage number, different dies of the number corresponding to the types of the turbine blades to be forged are required, and the number of the required dies is increased.

However, in a case where at least two of a plurality of the turbine blades are the turbine blades of different types having the different stage numbers, it is possible to forge at least two types of the turbine blades with a single die. As a result, the number (type) of the required dies is decreased, and cost for the dies can be effectively reduced.

Since the turbine blade is obtained by production in a small scale, a ratio of the cost for the die to a total cost for one forged product (turbine blade) is inevitably high.

According to item 6 above, the cost for the die per the one forged product can be effectively decreased, because the two types of the turbine blades can be simultaneously forged with a single die.

In this case, according to item 7 above, it is preferable that the turbine blades of different types having the different stage numbers are turbine blades on adjacent stages which are different from each other by one stage.

There is a small difference in shape between the turbine blades on the adjacent stages which are different from each other by one stage. Therefore, these turbine blades can be more easily forged, as compared with a case where the turbine blades of two types having a large difference in shape between them are forged in a connected state with a single die.

DESCRIPTION OF THE REFERENCE NUMERALS AND SIGNS

Figure 1:
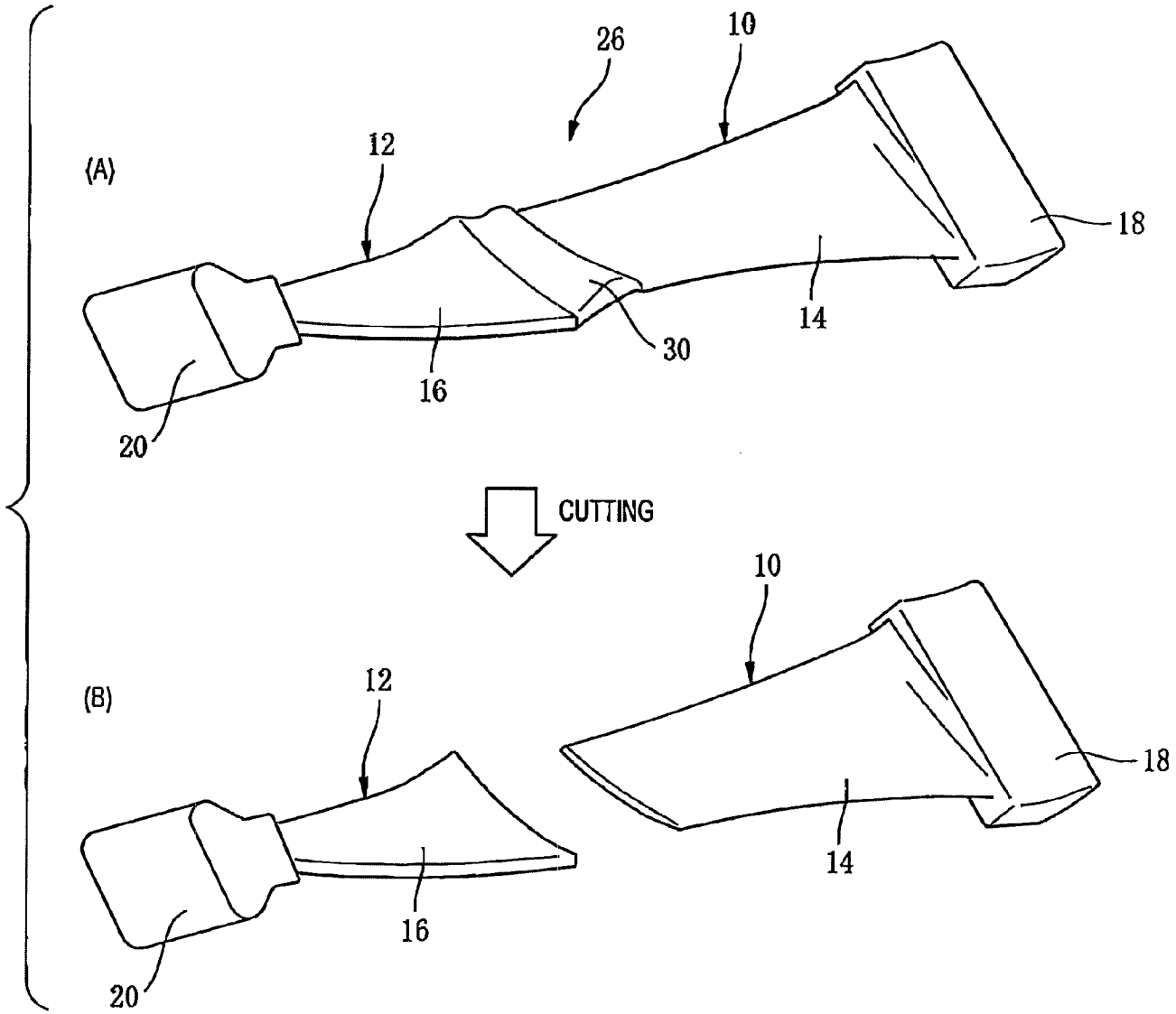
FIG. 1 is a view showing blades which are the turbine blades as one example of an object of application of the invention, in a state of single bodies and in an integrally connected state.

10, 12 Blade (turbine blade)
14, 16, 36, 38 Blade part
18, 20 Blade root
26 Connected body
30 Connecting part
32, 34 Vane

BEST MODE FOR CARRYING OUT THE INVENTION

Now, an embodiment of the invention will be described in detail, referring to the drawings.

In (B) of FIG. 1, reference numerals 10 and 12 represent turbine blades as the object of application of the embodiment. Specifically, in this embodiment, the turbine blades 10 and 12 are blades for a gas turbine. The turbine blades 10 and 12 are respectively provided with blade parts 14 and 16 having a smaller wall thickness, and blade roots 18 and 20 having a larger wall thickness, integrally.

As material for the blades 10 and 12, material of JIS SUS410J1, DIN X12Cr13, EN 1.4006, EN 1.4024, UNS S41025, UNS S41000, AISI 410 or the like is preferably used.

In this embodiment, the blades 10 and 12 are of different types and different stage numbers. However, a difference in the stage number is only one stage. The blade 10 having a larger size is of the n-th stage, and the blade 12 having a smaller size is of the (n+1)-th stage.

Therefore, the blade 10 and the blade 12 are very close to each other in shape.

These blades 10 and 12 are fixed to a disc of a rotor at their blade roots 18 and 20 which are the thick-walled parts, thereby to rotate integrally with the rotor.

It is to be noted that the thin-walled blade parts 14 and 16 have a distorted shape. As shown in (B) of FIG. 1, the blade parts 14 and 16 are distorted in opposite directions, in a state where they are oppositely directed to each other in the longitudinal direction.

Figure 2:
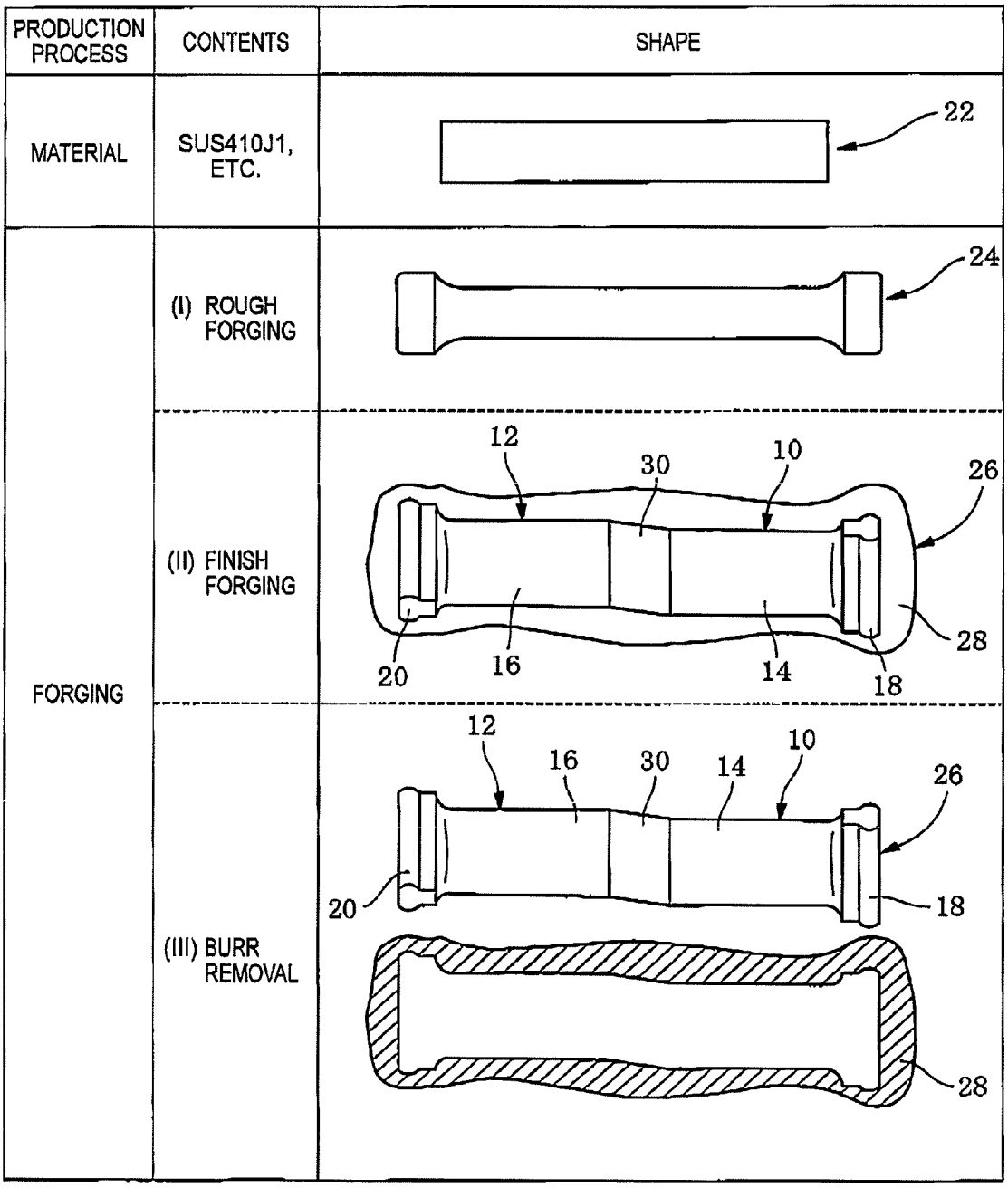
FIG. 2 is a chart for explaining processes in the forging method in an embodiment according to the invention.

FIG. 2 shows processes in the method of forging these blades 10 and 12 in this embodiment.

In FIG. 2, reference numeral 22 represents forging material in a shape of a rod which is formed of material of JIS SUS410J1 (other materials may be used). This forging material 22 is roughly forged in process (I) to be formed into a preformed product 24 which is provided with thick-walled parts at both ends thereof.

Then, in process (II), the preformed product 24 is subjected to finish forging, and a connected body 26 in which the blades 10 and 12 are integrally connected in the longitudinal direction can be obtained as a finish forged product in a state of being provided with a burr 28.

Thereafter, removal of the burr 28 is conducted in process (III), and the burr 28 is separated and removed from the connected body 26.

As shown in (A) of FIG. 1 and FIG. 2, in this embodiment, the two blades 10 and 12 as the turbine blades are simultaneously forged with a single die, as the connected body 26 which are integrally connected in the longitudinal direction.

The blades 10 and 12 arc integrally forged in a state where they are oppositely directed in the longitudinal direction, so that the blade roots 18 and 20 as the thick-walled parts may be positioned at both ends of the connected body 26 in the longitudinal direction.

In the connected body 26, reference numeral 30 represents a connecting part which is provided between an end of the blade 10 and an end of the blade 12 as a superfluous part for connecting the respective ends of the blades 10 and 12. The blades 10 and 12 are integrally forged in a state of being connected to each other through this connecting part 30.

This connecting part 30 is provided as a shape transition part which smoothly connects the end of the blade 12 at a right side in the drawing to the end of the blade 10 at a left side in the drawing, through a shape change of the connecting part itself.

Specifically, a shape of the connecting part 30 at its left end in the drawing is the same as a shape of the blade 12 at its right end in the drawing, and a shape of the connecting part 30 at its right end in the drawing is the same as a shape of the blade 10 at its left end in the drawing. At the same time, the connecting part 30 sequentially changes in shape from the left end to the right end thereof in the drawing, and the shape of the connecting part 30 transitions from the shape of the blade 12 at the right end thereof to the shape of the blade 10 at the left end thereof.

Figure 3B:
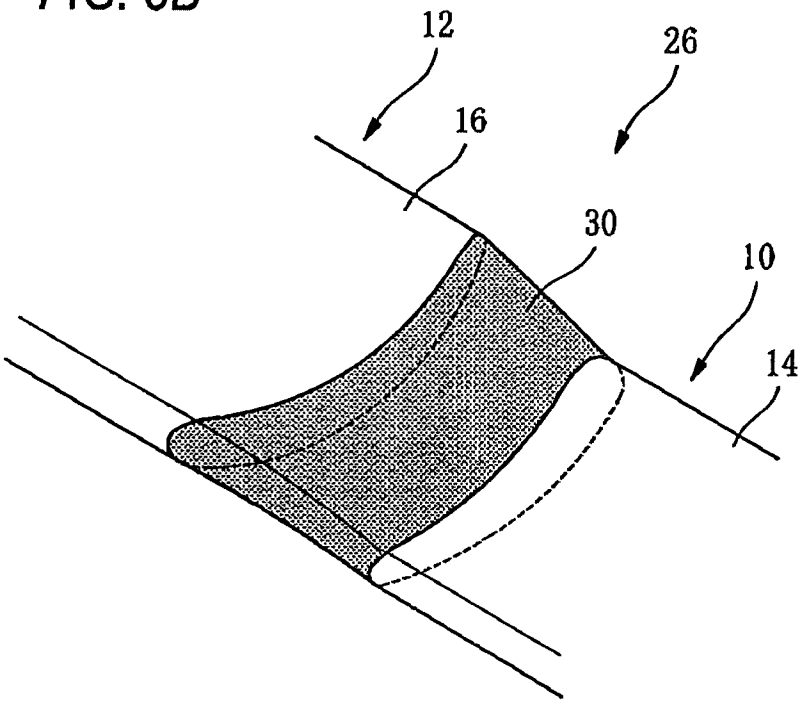
FIGS. 3A and 3B are views showing an essential part in FIG. 2 together with a comparative embodiment with respect to the embodiment according to the invention.
Figure 3A:
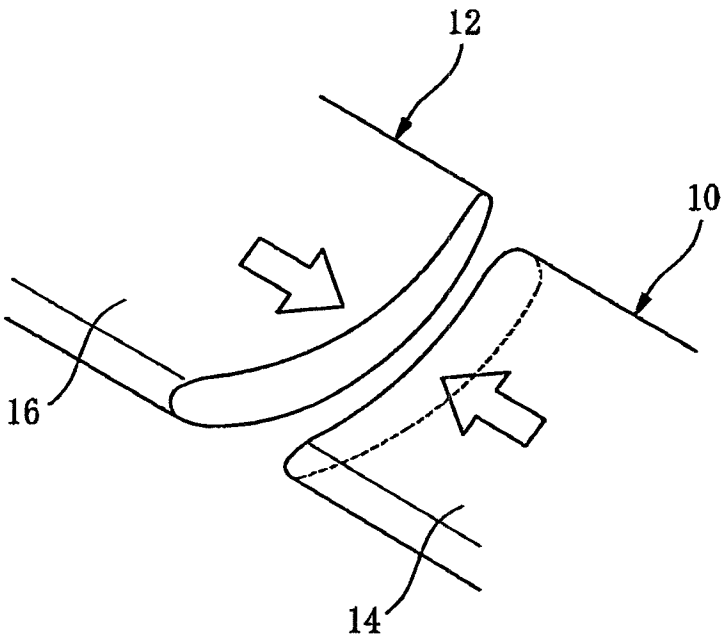

For example, in a case where the blades 10 and 12 arc forged in the connected state in such a manner that the respective blade parts 14 and 16 of the blades 10 and 12 are directly butted against each other without providing the connecting part 30, as shown in FIG. 3A, a step height occurs in a region where the blade parts 14 and 16 of the blades 10 and 12 are butted. This is because the blades 10 and 12 are oppositely directed in the longitudinal direction, and distorted in the opposite directions, and furthermore, they are also different from each other in width and thickness (Incidentally, in FIG. 3A, the blade parts 14, 16 are shown in a separated state for easy understanding).

In a case where the connected body 26 having such a step height is forged, a crack may occur in the forged product due to the step height, and there are technical difficulties in the forging work.

For this reason, in this embodiment, as shown in FIG. 3B, the connecting part 30 for connecting the end of the blade 12 with the end of the blade 10 is provided as the shape transition part for realizing sequential shape transition, so that the step height may not occur between the blades 10 and 12.

As a result, when the blades 10 and 12 are forged in the mutually connected state as the connected body 26, it is possible to forge them into a favorable shape without generating a crack on the forged products.

In this embodiment, the connected body 26 which has been thus obtained is then separated into the blade 10 and the blade 12.

On this occasion, after the blades 10 and 12 have been separated into single bodies, or in the mutually connected state, that is, as the connected body 26, machining for finishing them into a final shape and size is conducted.

The latter case is desirable, because the two blades 10 and 12 can be simultaneously subjected to the machining, and the number of processes of the machining can be effectively reduced. Besides, the connected body 26 which has been obtained according to this embodiment has the blade roots 18 and 20 as the thick-walled parts at the both ends in the longitudinal direction, and furthermore, the connecting part 30 is provided at an intermediate position in the longitudinal direction, Therefore, on occasion of applying the machining, it is possible to firmly hold the connected body 26 by grasping the blade roots 18 and 20 at the both ends and the connecting part 30 with chucks of a machining device, and it is possible to conduct the machining in this state while sway of the connected body 26 is suppressed.

According to the embodiment as described above, it is possible to obtain the blades 10 and 12 (turbine blades) as the two forged products from a single forging material 22, with high efficiency. Moreover, an amount of burr occurring during the forging work can be decreased, and hence, a yield of material can be enhanced, as compared with a case where the blades 10 and 12 are forged as a single body.

Further, a plurality of the blades 10 and 12 can be forged by one time of forging and the number of processes of the forging work can be reduced, so that the productivity can be enhanced.

According to the forging method in this embodiment, since the two blades 10 and 12 can be obtained in a mutually connected state, on occasion of the machining after forging, the two blades can be simultaneously subjected to the machining.

According to the invention, it is also possible to forge a plurality of the turbine blades of the same type having the same stage number in the connected state. In this case, a plurality of dies of the number (type) corresponding to the types of the turbine blades are required. However, in this embodiment, since the blades 10 and 12 of the different types having the different stage numbers are forged as the turbine blades in a connected state, the two types of the blades 10 and 12 can be forged with a single die. As a result, the number (type) of the required dies is decreased, and cost for the dies can be effectively reduced.

Since the blade is obtained by production in a small scale, a ratio of the cost for the die to a total cost for the one blade is inevitably high.

According to this embodiment, the cost for the die per the one forged product can be effectively decreased, because the two types of the blades 10 and 12 can be simultaneously forged with a single die.

Moreover, there is a small difference in shape between the blades 10 and 12, because their stage numbers are different from each other by only one stage. Therefore, it is possible to easily forge the blades 10 and 12, as compared with a case where two types of the blades having a larger difference in shape are forged with a single die.

Although the above description is related to the blades, it is also possible to apply the invention to forging of vanes at a fixed side.

Figure 4B:
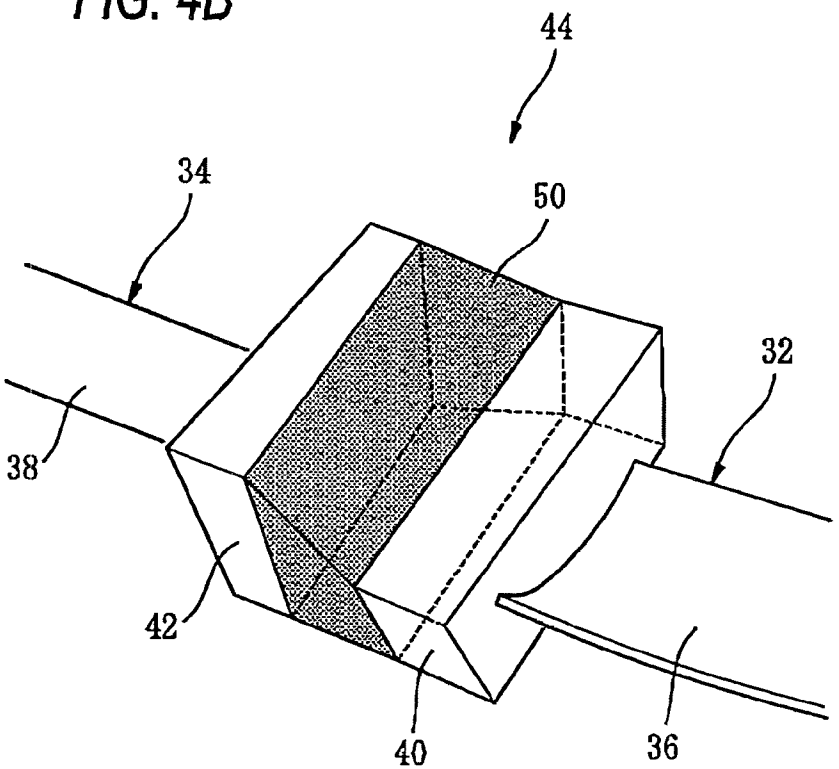
FIGS. 4A and 4B are views showing an essential part in another embodiment according to the invention with a comparative embodiment with respect to the embodiment.
Figure 4A:
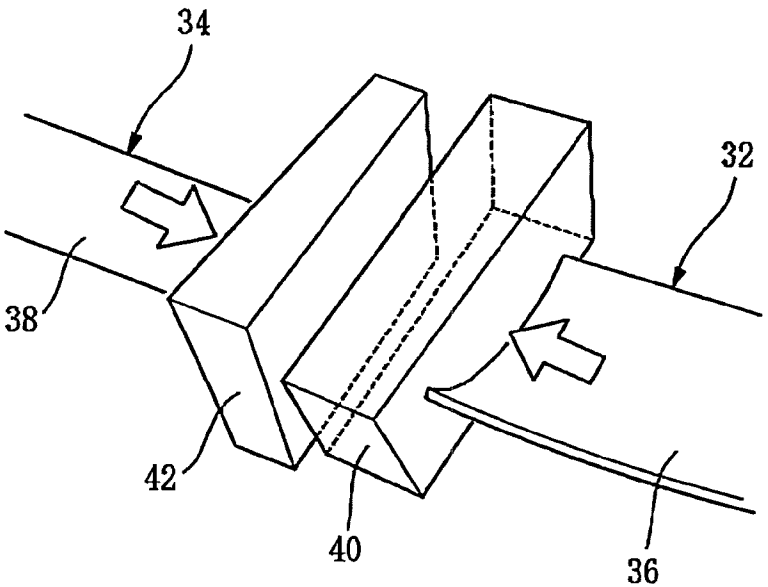

In FIGS. 4A and 4B, reference numerals 32 and 34 represent the vanes. Herein, the vanes 32 and 34 are set to be different in the stage number from each other. Specifically, the stage numbers of the vane 32 and the vane 34 are different by one stage.

Reference numerals 36 and 38 respectively represent blade parts of the vanes 32 and 34.

The vane 32 is integrally provided with a blade root (not shown) as a thick-walled part to be fixed to a turbine casing, at a right end side in the drawing, and in the same manner, the vane 34 is integrally provided with a blade root (not shown) as a thick-walled part to be fixed to the turbine casing, at a left end side in the drawing.

These vanes 32 and 34 are integrally provided with shrouds 40 and 42 to be fixed to an annular member which is formed in an annular shape around a rotor shaft, at their ends at an opposite side to the blade roots, that is, at the respective ends at a radially inner side in a state where they are fixed to the turbine casing.

Reference numeral 44 represents a connected body in which the vanes 32 and 34 are integrally connected so as to be oppositely directed in the longitudinal direction.

Specifically, also in this embodiment, the vanes 32 and 34 are integrally connected in the longitudinal direction so as to be oppositely directed in the longitudinal direction thereby forming the connected body 44.

The shrouds 40 and 42 which are juxtaposed are connected to each other by means of a connecting part 50, in the same manner as in the above described embodiment.

Also in this embodiment, the connecting part 50 has a function of the shape transition part.

Incidentally, processes and procedures for forging the two vanes 32 and 34 as the connected body 44 are basically same as the case of producing the blades as shown in FIG. 2.

FIG. 4A is a view corresponding to FIG. 3A, and shows that a step height occurs in a region where the vanes 32 and 34 are butted against each other, when the two vanes 32 and 34 are forged in a connected state where they are directly butted.

Also in a case where the two vanes 32 and 34 are forged as the connected body 44 according to this embodiment, it is possible to conduct the machining with grasping the blade roots at both ends in the longitudinal direction with chucks of the machining device.

At the same time, it is possible to conduct the machining with grasping the connecting part 50 in an intermediate part with a chuck.

The embodiments of the invention have been heretofore described in detail. However, the embodiments have been described only as examples.

For example, in the above described embodiments, the case where the two turbine blades of different types which are different from each other by only one stage in the stage number are forged in the connected state has been described. However, it is also possible, according to the invention, to forge the two turbine blades which are different by more than one stage (i.e., two stages or more) in the stage number in the connected state.

Further, in the above described embodiments, the case where the two turbine blades are forged in the connected state has been described. However, particularly in case of forging the turbine blades having a small size, irrespective of the blades or the vanes, it is also possible to forge a plurality of the turbine blades, more than two (i.e., three or more), in the connected state.

In this case, it is desirable to form the connected body in such a manner that the thick-walled parts are positioned at both ends of the connected body in the longitudinal direction.

Besides, the invention can be made in such a mode that various modifications are added to the invention within a scope not deviating from a gist of the invention. For example, the invention can be also applied to production of blades for other turbines than the gas turbine.

This application is based on Japanese patent application No. 2011-152493 filed Jul. 11, 2011, the entire contents thereof being hereby incorporated by reference.

What is claimed is:

1. A method of turbine blade forging, which comprises forging a plurality of turbine blades as an integrally connected body in a longitudinal direction, and then separating the integrally connected body into said respective turbine blades, wherein at least two of said plurality of turbine blades are turbine blades of different types in which stage numbers are different from each other.

2. The method of turbine blade forging as claimed in claim 1, wherein said forging is carried out in such a manner that thick-walled parts having a larger wall thickness than blade parts are positioned at both ends in the longitudinal direction of adjacent two turbine blades in a state of being integrally connected.

3. The method of turbine blade forging as claimed in claim 2, wherein both of said two turbine blades are a blade, and said forging is carried out in a state where the turbine blades are oppositely directed in the longitudinal direction, so that blade roots as the thick-walled parts are positioned at the both ends in the longitudinal direction.

4. The method of turbine blade forging as claimed in claim 1, wherein the turbine blades of different types in which the stage numbers are different from each other are turbine blades on adjacent stages which are different from each other by one stage.

5. The method of turbine blade forging as claimed in claim 1, wherein a connecting part is provided between adjacent ends of said respective turbine blades as a superfluous part for connecting said ends of the turbine blades, and the turbine blades are forged in a state of being integrally connected in the longitudinal direction through the connecting part.

6. The method of turbine blade forging as claimed in claim 5, wherein the connecting part is provided as a shape transition part, in which a shape of the connecting part sequentially changes from its one end to the other end which have different shapes from each other, so that the shape is transitioned from the one end to the other end.

* * * * *